United States Patent [19]

Heath

[11] 3,992,847

[45] Nov. 23, 1976

[54] METHOD AND APPARATUS FOR INSTALLING INSULATION

[75] Inventor: Wesley Gene Heath, Houston, Tex.

[73] Assignee: B & C Construction Company, Inc., Houston, Tex.

[22] Filed: Mar. 1, 1976

[21] Appl. No.: 662,614

[52] U.S. Cl. ..... 52/743; 52/750; 156/71; 156/577

[51] Int. Cl.[2] ..... E04G 21/14; E04B 1/62

[58] Field of Search ..... 52/743, 749, 750, 222; 270/31; 19/163; 156/71, 523, 577

[56] References Cited

UNITED STATES PATENTS

| | | | |
|---|---|---|---|
| 964,124 | 7/1910 | Shapera et al. | 270/31 |
| 976,604 | 11/1910 | Sampson | 270/31 |
| 993,943 | 5/1911 | Atmore | 270/31 |
| 1,427,755 | 8/1922 | Harris | 52/746 |
| 2,126,956 | 8/1938 | Gilbert | 52/746 |

*Primary Examiner*—James L. Ridgill, Jr.
*Attorney, Agent, or Firm*—Carl B. Fox, Jr.

[57] ABSTRACT

Method and apparatus for installing insulation, wherein insulation carried in a roll is held by a carriage which rolls along structural members of a building, the insulation being unrolled and moved downwardly from the carriage to a vertically disposed position at the location of a wall of the building for installation. The carriage is then moved to an adjacent position and another vertical strip of insulation is unrolled and moved to a position parallel to the first strip for installation. Provision is made for tensioning the insulation strips as they are installed to eliminate wrinkling.

10 Claims, 3 Drawing Figures

METHOD AND APPARATUS FOR INSTALLING INSULATION

BACKGROUND OF THE INVENTION

Insulation for certain types of buildings, particularly relatively large metal buildings, is supplied in roll form, and the insulation is installed in vertical side-by-side strips. The insulation is in the form of an elongate pad having a backing which extends outwardly from the sides of the insulation pad for use in connecting adjacent strips of insulation together. The strips of insulation are usually connected together by inturning the side backing strips toward their insulation side and stapling them together.

Installation of insulation in this manner when done by hand is somewhat difficult and expensive. The insulation rolls must be handled and unrolled from the roof of the building to be insulated, before the metal roof sheeting is installed, and the workers must work from the structural frame members of the building or construct scaffolds to work from which must most often be moved to a new location for each strip of insulation. The insulation strips must be unrolled by hand and held in place while other workmen fasten them in place. For most jobs, this has required at least four men. Using the described method and apparatus according to the invention, no more than two men per crew are usually required, so that a considerable saving in labor cost is realized. In addition, use of the invention will improve safety, since the persons working atop the building will be on a safe platform provided by the apparatus.

SUMMARY OF THE INVENTION

According to the invention, an apparatus is provided which is designed to roll along the roof structural members of the building to be insulated, adjacently paralled to each wall to be insulated. In metal buildings as presently almost universally constructed, purlins are provided which are disposed over the rafters and crossways of the rafters, and the purlins serve as tracks for the apparatus according to the invention to be supported by and to roll along. The wheel spacings of the apparatus are adjustable, so that purlins of different spacings may be used as tracks for the apparatus.

The carriage of the apparatus supports a roll which supports the insulation roll. The insulation is unrolled by operation of a crank, or similar substituted so that the insulation strips are fully controlled as they are dropped downwardly from the apparatus. The positioning of the strips as they are dropped is improved, since the rolling carriage may be accurately positioned along the lengths of the purlins. The elevations of the wheels of the carriage are adjustable, so that the apparatus may be used on pitched roofs as well as on flat roofs. The apparatus supports each subsequent strip of insulation while it is connected to the building structure for support, and while it is stapled to the adjacent insulation strip. As mentioned earlier, the apparatus makes it possible to stretch each insulation strip as it is installed to remove wrinkles, by simply tightening the strip by use of the crank used to lower the strips after the bottom end of the strip has been anchored in place. After each strip has been fully connected and supported, the top of the strip may be cut from the insulation leading from the roll of insulation, and the carriage moved to the location of the next adjacent strip of insulation. The workmen work from walkways provided by the apparatus, so that danger of falling and other mishaps at the roof of the building is greatly reduced.

A principal object of the invention is to provide methods and apparatus for use in installing insulation in walls of buildings, particularly of metal buildings, which are safe and efficient. Another object of the invention is to provide such methods and apparatus wherein a carriage is provided which may be rolled along structural elements of the roof of a building from which insulation may be installed in the walls of the building. A further object of the invention is to provide such methods and apparatus wherein said carriage carries the insulation in roll form and includes means for lowering strips of insulation from the roll to position for installation, with constant control of each insulation strip as it is lowered and fastened in place. Another object of the invention is to provide such methods and apparatus use of which will reduce the labor requirements and cost of installing the insulation.

Other objects of the invention will appear from the following detailed description of preferred embodiments of the methods and apparatus, reference being made to the accompanying drawings.

BRIEF DESCRIPTIONS OF THE DRAWINGS

DESCRIPTIONS OF THE PREFERRED EMBODIMENTS

Figures 1, 2, 3:
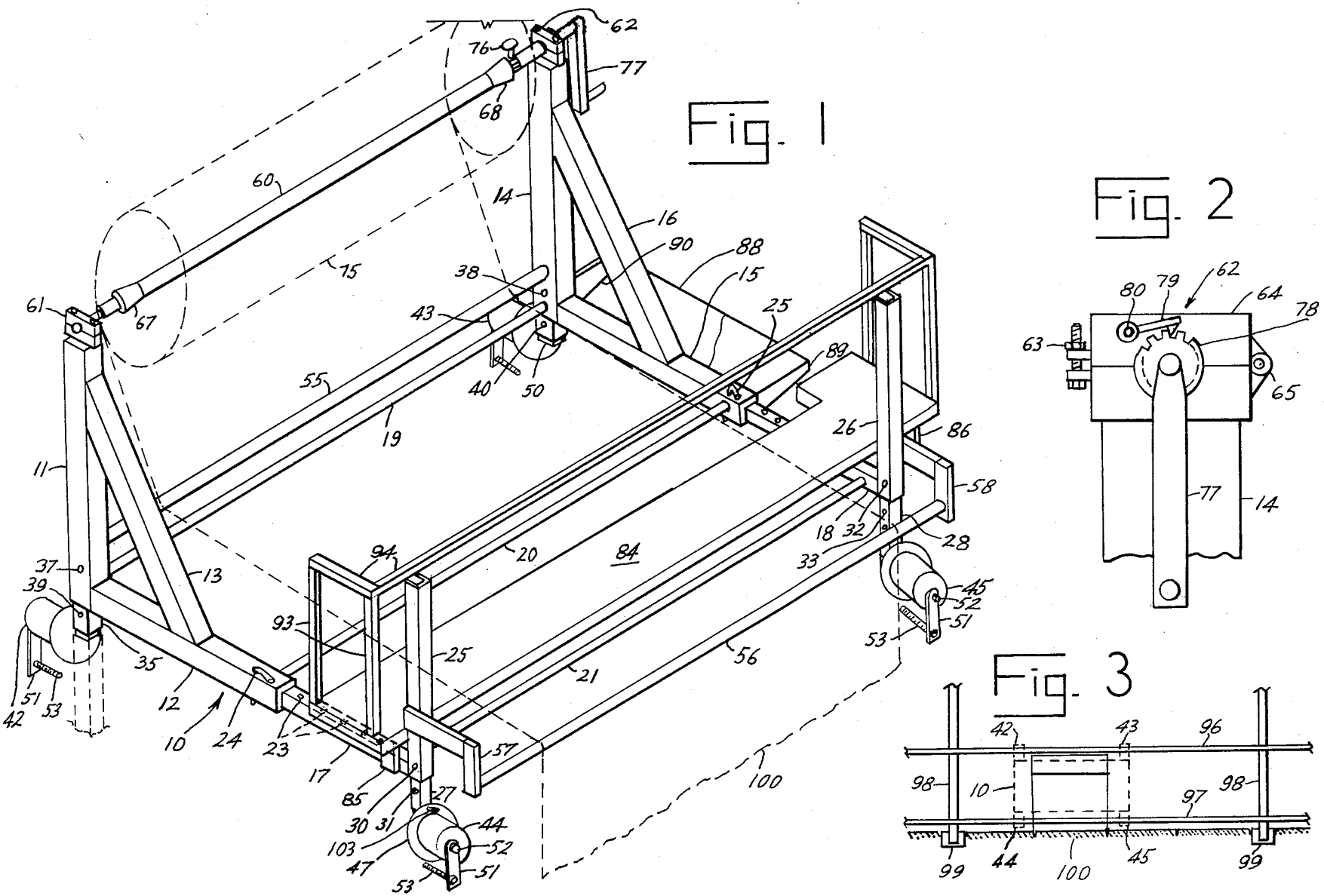
FIG. 1 is a perspective view showing a preferred embodiment of apparatus according to the invention.
FIG. 2 is an enlarged partial view showing a portion of the apparatus of FIG. 1.
FIG. 3 is a schematic view which, in conjunction with FIG. 1, illustrates a preferred embodiment of the methods according to the invention.

Referring now to the drawings in detail, and first to FIG. 1, the apparatus includes a frame 10 which serves as a carriage for carrying a roll of insulation and which can be rolled along structural elements of a building to carry the roll of insulation to a location for installation. The frame or carriage 10 is made up of members 11–20. Members 11–16 are made of square tubular stock of one size, and members 17–18 are made of square tubular stock of a smaller size capable of being telescoped into members 12 and 15, respectively. Members 11, 14 are disposed vertically, with members 12, 15 welded or otherwise suitably affixed thereto to extend horizontally from their lower ends. Members 13 and 16 are angular brace members, affixed between members 11, 12 and 14, 15, respectively. Members 19, 20 are made of bar stock, and are affixed between members 12, 15 as shown. Members 17, 18 are telescoped into members 12, 15 and an additional frame member 21 of bar stock is affixed by welding therebetween. Members 12, 15 each have a hole through their upper and lower sides, and members 17, 18 have plural holes 23 through their upper and lower sides spaced along their lengths, and pins 24, 25 are placed through the holes of members 12, 17 and 15, 18, respectively, with members 17, 18 extended to the desired distance from members 12, 15. The width of the carriage may be adjusted by bringing different holes of members 17, 18 into register with the holes of members 12, 15.

Square tubes 25, 26 are affixed vertically to the ends of members 17, 18 as shown, by welding or other suitable means. Smaller square tubes 27, 28 are telescoped into the lower ends of tubes 25, 26 and their downward extent is adjustably fixed by pins inserted into holes 30,

31 and 31, 32, holes 31, 33 being plural and spaced along tubes 27, 28 to provide the adjustment. In the same way, smaller tubes 35, 36 are adjustably fixed in tubes 11, 14. Holes 37, 38 and plural spaced holes 39, 40 are provided to permit downward length adjustment of tubes 35, 36. Wheels 42–45 are provided at the lower ends of tubes 39, 40, 27 and 28, respectively.

Each wheel 42–45 consists of a circular disc plate 47 and a concentric closed-ended drum 48 welded thereto. The plate and the closed end of the drum have a concentric shaft affixed therethrough, the plate end of the shaft being journaled in a bearing 50 carried at the lower end of each of the tubes 27, 28 and 39, 40. The other end of each shaft has the end hole of a toggle bar 51 threaded thereover, held thereon by an end nut 52. The lower end of each toggle bar 51 has a tapped opening therethrough into which is screwed a screw 53 extending inwardly under the wheel. The toggle bars 51 and screws 53 are provided as means for retaining the wheels against too much vertical movement away from the building members serving as tracks when the apparatus is in use.

An elongate roller 55 is disposed rotatably between tubes, 11, 14 spaced above bar 19. Another elongate roller 56 is supported rotatably between L-shaped supports 57, 58 depending from tubes 25, 26, as shown. A roller 60 is supported for rotation by bearings 61, 62 carried at the upper ends of tubes 11, 14. Bearings 61, 62 are split bearings (see FIG. 2) which may be opened for removal of roller 60. By removal of nut 63, upper bearing half 64 may be pivoted up at hinge 65 to release the end of roller 60, bearing 61 being the same.

Roller 60 has a conical wedge 67 fixed around its left-hand end. A second conical wedge 68 is disposed around the right-hand end of roller 60, movable longitudinally of roller 60 and removable from the end of the roller. By removing wedge 68, a roll 75 of insulation having a tubular core may be placed on the roller, the wedge 68 then being placed around the roller and fixed in place with the core of the roll of insulation jammed tightly between the two wedges 67 and 68 so as to be non-rotatable on roller 60. Wedge 68 is fixed on roller 60 by tightening a set screw 76, or by other suitable affixing means known in the art.

The right-hand end of roller 60 is releasably connected to the shaft of a crank 77 by a spline connection (not shown) or other suitable means at bearing 62, so that the roller end may be released for installation of a roll of insulation or for removal of the core of a used up roll of insulation. Crank 77 is used for unrolling the insulation strips from the roll, and for tightening the insulation during installation. The crank shaft has a gear or ratchet wheel 78 fixed therearound engagable by a pawl 79 pivotal at pin 80. The pawl tooth 81 is tapered at one side to permit rotation of the crank in the left-hand rotational direction (FIG. 2), but the pawl prohibits rotation of the crank in the opposite direction when the pawl is engaged with the ratchet wheel 78. This arrangement permits turning of roller 60 in a direction to rewind insulation onto the roll, as for tensioning a strip of insulation unwound from the roll, but prohibits unwanted and accidental unrolling of insulation from the roll caused by the weight of a strip of insulation hanging downwardly from the apparatus. The pawl is released from the ratchet wheel when insulation is to be drawn from the roll, and the pawl is reengaged when a strip of insulation of sufficient length has been unrolled.

A walkway 84 is supported by bars 85, 86 affixed by welding or bolting the tubes 17 and 18, the walkway or platform being elevated with respect to tubes 17 and 18 as shown. The surface of the walkway or platform will preferably be coated with a friction material to prevent the workmen's feet from slipping thereon. A second platform 88 is carried by brackets 89, 90 welded to the side of tube 15. This platform is shown to have an upper surface of expanded metal, but any other suitable construction for the platform may be used. A guardrail 92 formed by vertical members 93 welded to the platform structure and by horizontal rail members 94 is provided around the outer sides of platform 84. A similar guardrail may also be provided around platform 88 if desired.

Referring now also to FIG. 3 of the drawings, a pair of tracks 96, 97 for the carriage of the apparatus is provided by purlins of a building structure. The purlins are assembled across rafters 98 supported at their outer ends by vertical columns 99. When there are no purlins suitably positioned for use as tracks for the apparatus, elongate metal or wood members may be affixed in place as tracks for the apparatus to be moved along. For example, if the apparatus is to be moved along the end of a building which is pitched upwardly or is level, where no purlins are usually provided, tracks of any suitable form may be affixed in place to enable use of the apparatus in the manner described for use of the apparatus rolled along existing purlins. The carriage apparatus 10 is disposed on the tracks with the wheels 42–45 on the tracks and with the screws 53 beneath the tracks to prevent movement of the wheels from the tracks. The disc plates 47 of the wheels prevent lateral movements of the wheels off of the tracks, the width of the apparatus having been adjusted by proper telescopic extension of the tubes 17, 18 as before described. A roll of insulation, which may have a length of up to 100 feet or more, is placed on roller 60 in the manner described. The apparatus is moved to a location adjacently above where the insulation strip 100 is to be lowered along the path of a wall, and insulation is dropped in strip form from the roll 75, the insulation passing under roller 55 and over front roller 56 as shown in FIG. 1. The unrolled strip of insulation passes downwardly to the bottom of the wall, where it is fixed in place. The pawl 79 is then engaged with the ratchet wheel 78 to prevent further unwinding of insulation from the roll 75, and the crank may then be turned in a counterclockwise direction (FIG. 2) to tighten the insulation and remove any wrinkles. It will be realized that the insulation will have fewer wrinkles than would occur with hand unrolling of the insulation strip, since the roll and strip is fully controlled and supported. The insulation is cut off at the upper end of the strip, and the apparatus may then be moved to the location of another strip. The insulation will of course be secured in place at least at the upper end before it is cut off and released from the apparatus. When the roll of insulation has been used up, the core is removed from roller 60 and a new roll of insulation is installed on roller 60.

In order to prevent unwanted and accidental rolling of the apparatus along the tracks during use of the apparatus, a brake is provided. The brake may take any suitable form, for example, one or more holes may be provided through the disc of one or more of the wheels 42–45, a location matching hole being provided through the adjacent tube 27–28 and 39–40. A pin 103 may be inserted through the aligned holes of disc and tube to prevent wheel rotation, thus insuring that the apparatus will not roll along the tracks when such is not desired.

The invention provides safe, economical and reliable methods and apparatus for installation of insulation in the vertical walls of buildings. From the foregoing descriptions of preferred embodiments, the merits of the invention should be fully appreciated.

While preferred embodiments of the methods and apparatus according to the invention have been described and shown in the drawings, many modifications thereof may be made by a person skilled in the art without departing from the spirit of the invention, and it is intended to protect by Letters Patent all forms of the invention falling within the scope of the following claims.

I claim:

1. Apparatus for use for installing insulation in vertical walls, comprising wheeled support means adapted for rolling movement along track means, first roller means for supporting a roll of insulation in elongate strip form disposed with its core parallel to the direction of movement of said support means, means for preventing rotation of said core and roll with respect to said first roller means, means for rotating said first roller means to rotate said roll of insulation for unwinding and rewinding of a strip of insulation thereon, means for guiding a strip of insulation unrolled from said roll for downward discharge from a side of said support means parallel to said direction of movement thereof.

2. The combination of claim 1, said support means including means for extend and retracting the insulation strip discharge side of said support means, a pair of wheels spaced along said discharge side of said support means for engaging a first track, a pair of wheels spaced along the opposite side of said support means for engaging a second track parallel to said first track, said extending and retracting means enabling engagement of said wheels on tracks of different spacings.

3. The combination of claim 2, including means for locking said first roller means against rotation in an insulation strip unwinding direction.

4. The combination of claim 3, including brake means for prevention of movement of said support means along said tracks when said brake means is engaged.

5. The combination of claim 4, said support means comprising a frame including a pair of horizontal tubular members, first and second elongate means telescopingly engaged with said pair of parallel tubular members providing said means for extending and retracting said discharge side of said support means.

6. The combination of claim 5, said support means frame including four vertical tubular members adjacent the corners thereof, elongate means telescopingly engaged with each said vertical tubular member carrying one of said wheels and providing vertical wheel adjustment whereby said wheels are engageable with tracks at different levels and with parallely inclined tracks.

7. The combination of claim 6, said insulation strip guiding means comprising a pair of guide rollers, said first roller being disposed at the side of said support means opposite said discharge side, one of said guide rollers being beneath said first roller, the other of said guide rollers being disposed along said discharge side of said support means, said insulation strip being passed from said roll beneath said one guide roller and over said other guide roller and then downwardly from said discharge side of said support means.

8. The combination of claim 7, including first platform means supported by said first and second elongate means and movable therewith providing support means for workmen adjacent said discharge side of said support means.

9. The combination of claim 8, indluding second platform means carried by said frame means adjacent said means for locking said first roller means and said means for rotating said first roller means.

10. Method for installing insulation in vertical walls of buildings, comprising providing a carrier rollable along tracks at the top of the wall supporting a roll of insulation in elongate strip form, unrolling a strip of insulation from the roll and guiding said strip downwardly in the line of the wall, fixing the lower end of said strip at the bottom of the wall, rewinding said strip at the roll to tighten said downwardly extending strip and remove wrinkles therefrom supporting said strip at the top of the wall, fixing the upper end of the strip to the top of the wall, cutting off the top of said strip from the insulation leading from the roll, rolling the carrier to the position of installation of another strip of insulation, and repeating the steps set forth.

* * * * *